United States Patent [19]

Johnston

[11] 4,116,525

[45] Sep. 26, 1978

[54] ELECTRICAL CONNECTOR ASSEMBLY

[75] Inventor: James J. Johnston, Old Saybrook, Conn.

[73] Assignee: Automatic Equipment Development Corporation, West Haven, Conn.

[21] Appl. No.: 763,281

[22] Filed: Jan. 27, 1977

[51] Int. Cl.[2] ..... H01R 9/00

[52] U.S. Cl. ..... 339/132 B; 339/192 R; 339/198 R; 339/198 S

[58] Field of Search ..... 339/17 L, 17 LC, 97 R, 339/97 P, 98, 99 R, 176 M, 176 MP, 156 R, 113 B, 198 R, 198 S, 217 S, 192 R, 150, 132

[56] References Cited

U.S. PATENT DOCUMENTS

| | | | |
|---|---|---|---|
| 2,927,296 | 3/1960 | Boss et al. | 339/113 B |
| 3,562,698 | 2/1971 | Merry | 339/217 S |
| 3,656,085 | 4/1972 | Holiday | 339/176 M |
| 3,760,335 | 9/1973 | Roberts | 339/99 R |
| 3,894,784 | 7/1975 | Clewes | 339/156 R |
| 4,009,922 | 3/1977 | Aysta | 339/99 R |

FOREIGN PATENT DOCUMENTS

| | | | |
|---|---|---|---|
| 271,271 | 5/1927 | United Kingdom | 339/183 |

*Primary Examiner*—Neil Abrams
*Attorney, Agent, or Firm*—McCormick, Paulding & Huber

[57] ABSTRACT

A male plug adaptor assembled with a high density multi-contact electrical receptacle adapts the receptacle to receive in direct plugging relation the bare terminal end portions of a multiplicity of individual cylindrical wires.

14 Claims, 10 Drawing Figures

ELECTRICAL CONNECTOR ASSEMBLY

BACKGROUND OF THE INVENTION

This invention relates in general to electrical distribution panels and the like and relates more particularly to an improved panel mounted multi-contact plug receptacle.

The improved receptacle assembly of the present invention is particularly adapted for use in distributing frames of the type used in telecommunication systems to provide flexibility in the association of one type of equipment with another. Key telephone units (KTU), Private-Branch-Exchange, (PBX) and Central Office (CO) equipment, for example, commonly utilize such distributing frames to provide facilities for terminating incoming cable pairs so that any cable pair may be connected to any line, trunk or other equipment by means of a conductor pair. In the industry there has been an increasing demand for improved miniaturized hardware to reduce space requirements for such distribution equipment. The present invention is primarily concerned with this problem. While the improved receptacle assembly of the present invention is particularly adapted for use with telecommunication equipment it will be readily apparent that the device will have other applications and will be generally suitable with use in any system requiring a high density circuit distribution panel, or the like.

SUMMARY OF THE INVENTION

In accordance with the present invention, a conductor adaptor for plugging assembly with a multi-contact electrical connector comprises a unitary structure which is made from electrical insulating material and includes an elongated panel section and a plugging section which projects downwardly from the lower surface of the panel section and extends longitudinally thereof. The plugging section defines at least one bearing surface normal to the lower surface. At least one longitudinally extending row of conductor receiving apertures is formed in the panel section. Each aperture in the one row opens through the upper and lower surface of the panel sections and communicates with an associated conductor guide slot which is formed in the plugging section opens through the one bearing wall. Each conductor guide slot is aligned with the contact portion of an associated electrical contact terminal carried by the connector when the adaptor is assembled with the connector.

DETAILED DESCRIPTION OF PREFERRED EMBODIMENT

Figure 1:
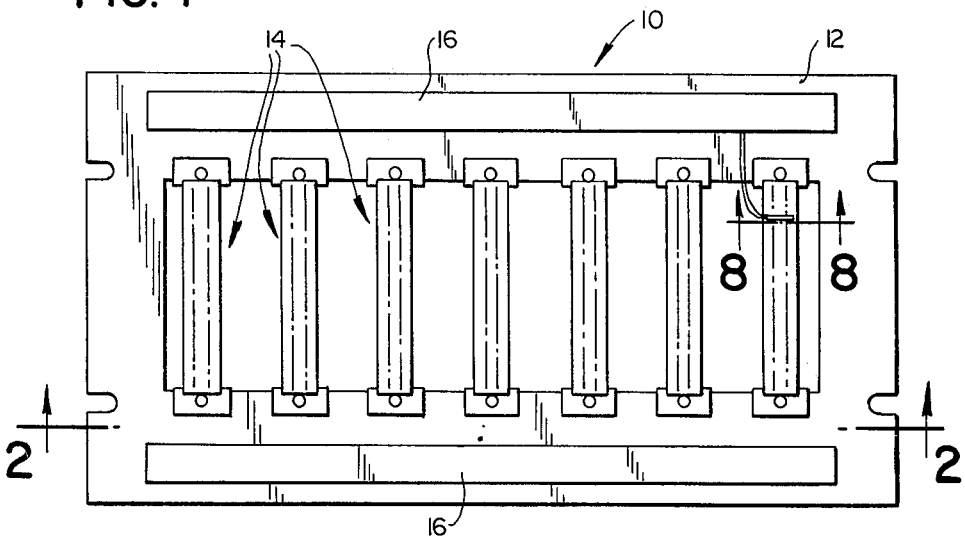
FIG. 1 is a plane view of a circuit distribution panel assembly embodying the present invention.

The present invention is illustrated and described with reference to a circuit distribution panel or frame particularly adapted for use in a communication system to terminate incoming cable pairs which are connected at the frame with associated pairs of electrical conductors. Turning now to the drawing and referring first particularly to FIGS. 1–3, a circuit distribution panel or frame embodying the present invention and indicated generally by the reference numeral 10 comprises a panel member 12 which has a plurality of individual circuit concentration bays indicated generally at 14, 14 mounted thereon. The bays 14, 14 are arranged in generally parallel relation and extend between a pair of wire ducts 16, 16 which are mounted on a face of the panel member 12 and extend generally along opposite sides thereof. Each bay 14 comprises a multi-contact, panel-mounted receptacle assembly, indicated generally at 18, which terminates a multiplicity of pairs of electrical conductors, which comprise an associated cable 20, and a conductor adaptor, indicated generally at 22, which is assembled in plugging relation with the receptacle assembly 18 and which adapts it to receive a multiplicity of individual electrical conductors or pairs of conductors in plugging connection therewith, as will be hereinafter further described.

Figure 2:
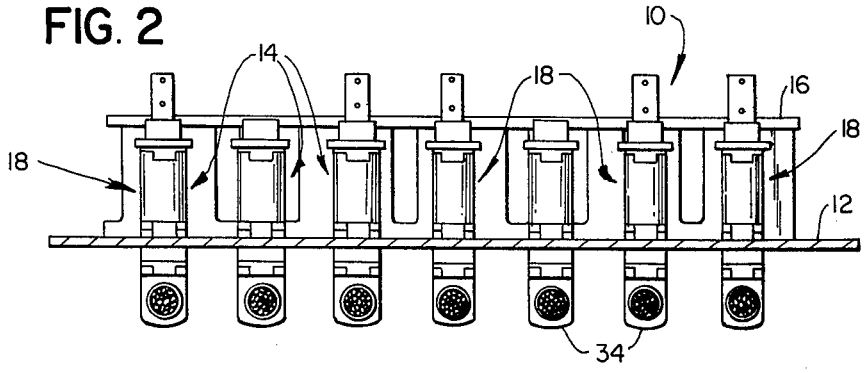
FIG. 2 is a sectional view taken along the line 2—2 of FIG. 1.
Figure 3:
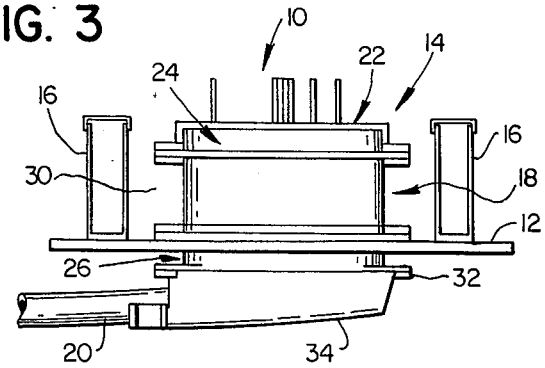
FIG. 3 is an end view of the panel assembly of FIG. 1.
Figure 4:
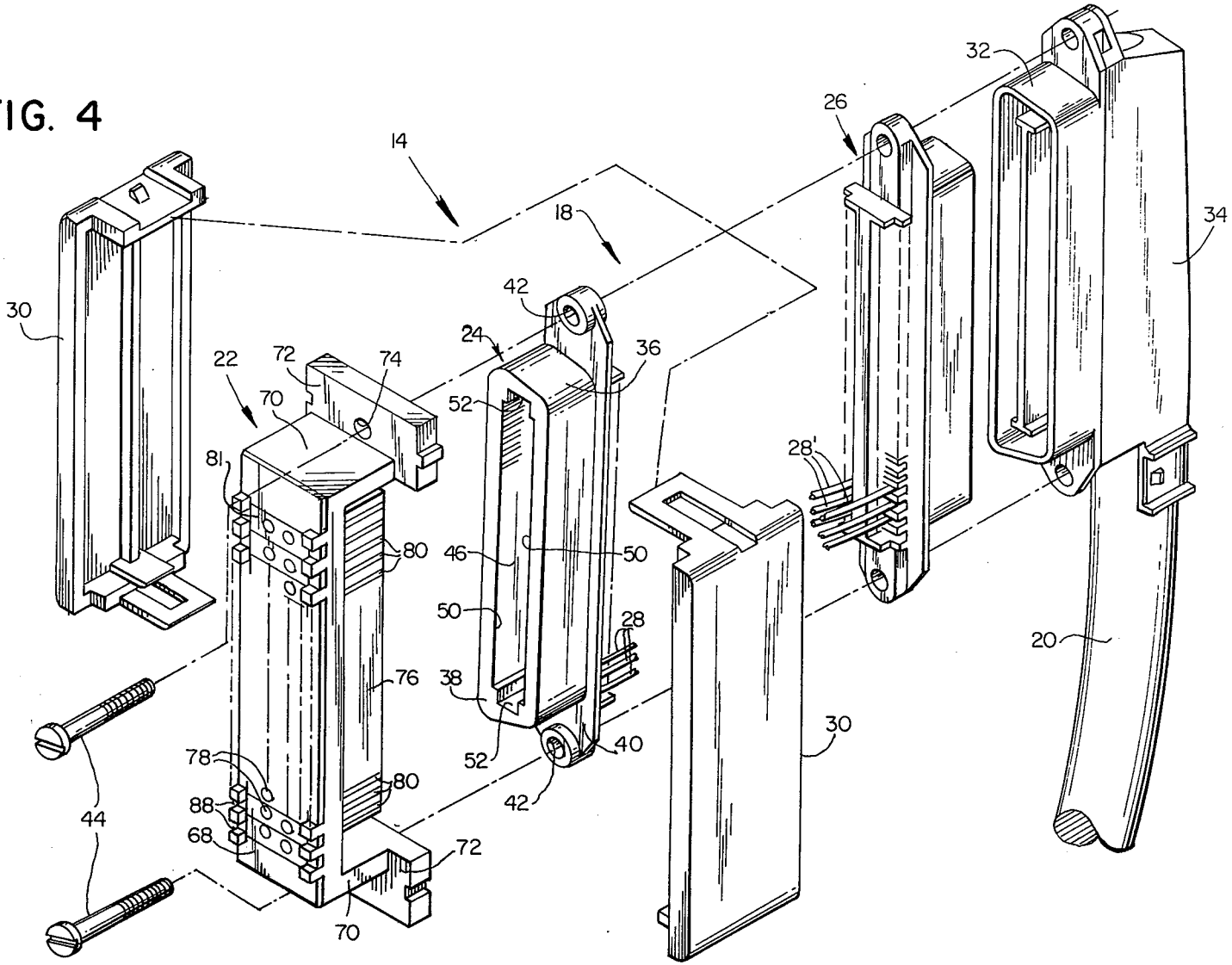
FIG. 4 is a somewhat enlarged exploded perspective view of a circuit concentration bay comprising a portion of the panel assembly of FIG. 1.

Considering now a typical circuit concentration bay 14 and referring particularly to FIG. 4, the illustrated receptacle assembly 18, which is shown in an exploded perspective, comprises a multi-contact connector or female receptacle 24 of a standard cable-to-panel type and another substantially identical multi-contact connector or female receptacle 26. The receptacles 24 and 26 are arranged in back-to-back relation and have respectively associated terminals interconnected by associated pairs of wire connectors such as indicated at 28, 28. The receptacles 24 and 26 are further assembled in connected relation by a pair of substantially identical strain relief covers 30, 30 which snap together in interlocking engagement with each other, in a manner well known in the connector art. A mounting base of the panel-mounted receptacle 26 is supported in engagement with the panel member 12, as best shown in FIGS. 2 and 3. The receptacle 24 is supported in spaced relation to the face of the panel member 12 by the strain relief covers 30, 30. A modular telephone adaptor plug 32, which includes a 90° tapered cover 34, is connected to the cable 20 and is arranged for plugging engagement with the receptacle 26 whereby to terminate a multiplicity of conductor pairs associated with the cable at the bay 14 and more specifically at electrical contacts within the receptacle 24, as will be hereinafter further described.

The illustrated receptacle assembly 18 and the adaptor plug 32 are items of standard manufacture and comprise an AMP CHAMP connector kit which includes a telephone adaptor plug and a pair of receptacles of 50 position type, intended for use with 25-pair cable of the type used in the communication industry and having a specific color coding scheme for identifying different pairs of wires, and is manufactured by AMP Incorporated, Harrisburg, Pennsylvania. However, it should be understood that standard connector components of other types, made by other manufacturers may also be used in practicing the present invention. Connector components of the aforedescribed general type are also manufactured by Cinch Connectors, An Electronic Components Division of TRW INC., Elk Grove Village, Ill. and Amphenol Industrial Division, Bunker Ramo Corporation, Chicago, Ill. for example, and such connector components may also be used in practicing the present invention.

Figure 8:
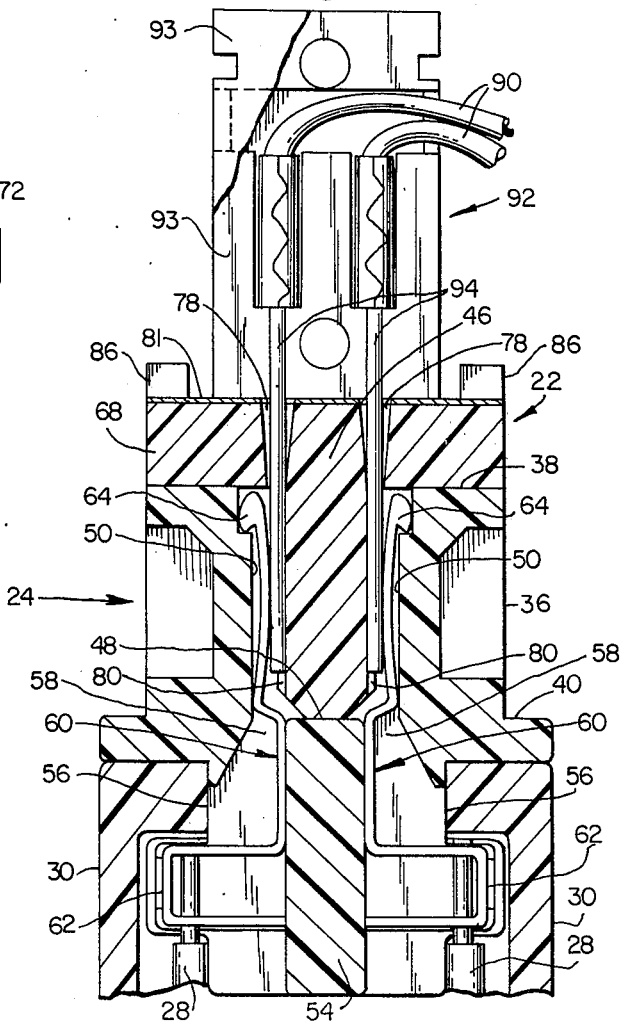
FIG. 8 is a somewhat further enlarged fragmentary sectional view taken along the line 8—8 of FIG. 1.

As previously noted, the conductor adaptor 22 is arranged for plugging engagement with the receptacle 24, which will now be considered in some further detail. Referring now particularly to FIGS. 4 and 8 the receptacle 24 has a housing 36 which is made from a suitable plastic material and has a mating side or face 38. A mounting flange 40 integrally formed on the housing 36 extends outwardly from opposite ends of the housing and has openings 42, 42 therethrough adapted to receive fasteners 44, 44 (FIG. 4). A trough-like recess 46 extends longitudinally of the housing 36 and opens through the mating surface 38. The latter recess is generally defined by a bottom wall 48, a pair of opposing side walls 50, 50 and end walls 52, 52, as best shown in FIGS. 4 and 8. A transversely extending rib 54 projects downwardly from the lower side of the housing and forms a stepped structure which defines laterally facing surfaces 56, 56 engaged by associated portions of the strain relief covers 30, 30, as shown in FIG. 8.

A plurality of contact receiving cavities, formed in the lower portion of the housing and indicated at 58, 58 in FIG. 8 open upwardly through the bottom wall 48 and communicate with the recess 46. These cavities are substantially identical to each other and arranged into parallel rows which extend longitudinally of the housing at opposite sides of the rib 54. Each cavity 58 contains a preloaded electrical contact terminal indicated generally at 60 which has a connecting portion 62 at its lower end and a contact portion 64 disposed within the recess 46.

As previously noted, the receptacle 24 comprises a 50 position connector and has 50 contact terminals for terminating 50 electrical conductors such as the conductors 28, 28. The terminals 60, 60 are arranged in two parallel rows within the housing with the contact surfaces thereof in opposing parallel relation adjacent opposite contact supporting side walls 50, 50 substantially as shown in FIG. 8. Each contacting portion 64 extends upwardly through an associated cavity 58 and is disposed within a shallow vertically extending recess within its associated side wall 50. Each contact portion 64 is slightly bowed inwardly at its center and toward the center of the recess 46, as best shown in FIG. 8. Each connector 28 has a bare end portion which is electrically and mechanically connected to a connecting portion 62 of an associated terminal 60. The end portion of each connector 28 is connected to its associated connecting portion 62 by being forcibly inserted into a slot (not shown) formed in the connecting portion. An understanding of the manner in which the conductors 28, 28 are attached to the connecting portions 62, 62 is not essential to an understanding of the invention, however, electrical connections of this general type are more fully disclosed in U.S. Pat. No. 3,617,983, and reference may be had to the aforesaid patent for disclosure, if desired. Further, reference may be had to U.S. Pat. No. 3,760,335, to Roberts, issued Sept. 28, 1973, for Pre-Loaded Electrical Connector, for additional disclosure of a receptacle of the type hereinbefore described.

Figure 5:
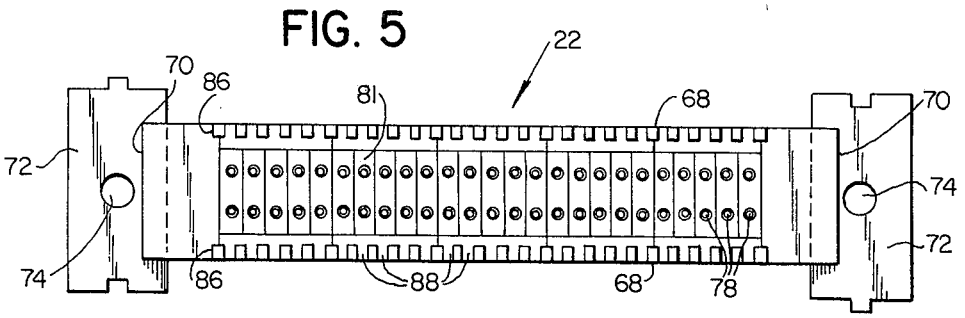
FIG. 5 is a plane view of a conductor adapter which comprises a part of the circuit concentration bay of FIG. 4.
Figure 7:
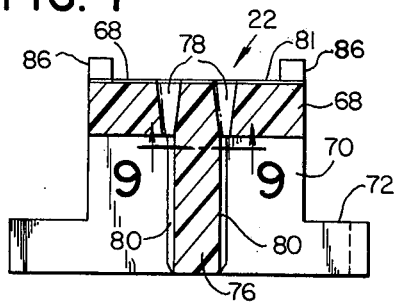
FIG. 7 is a somewhat enlarged sectional view taken along the line 7—7 of FIG. 6.
Figure 9:
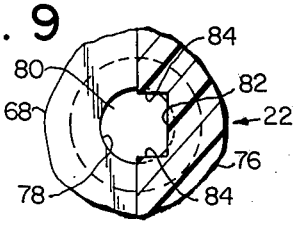
FIG. 9 is a fragmentary sectional view taken along the line 9—9 of FIG. 7.

The conductor adaptor 22 preferably comprises a unitary structure molded from a suitable dielectric plastic material and has an elongated generally rectangular panel section 68 adapted for overlying relation with an associated portion of the mating surface 38. The panel section 38 is of somewhat greater length than the mating surface 38 and has downwardly directing legs 70, 70 at its opposite ends. Each leg 70 carries a longitudinally outwardly extending mounting flange 72 which has an aperture 74 for receiving one of the fasteners 44, 44 therethrough. The adaptor 22 further includes an integral plugging portion or rib section 76 which projects downwardly from the central portion of the panel section 68 and extends longitudinally thereof. The rib section 76 is particularly adapted for plugging engagement within the recess 46 and has a cross sectional configuration substantially complementing the cross sectional configuration of the recess. The rib and panel portions of the adaptors 22 form a generally T-shaped cross section, as best shown in FIGS. 7 and 8. Two parallel rows of conductor receiving apertures 78, 78 are formed in the panel section and extend longitudinally thereof as best shown in FIGS. 4 and 5. The number and arrangement of the conductor receiving apertures generally corresponds to the number and arrangement of terminals carried by the receptacle 24. In the illustrated embodiment the receptacle 24 has 50 terminals arranged in two rows with 25 terminals in each row, therefore, the adaptor 22 is also provided with 50 conductor receiving apertures 78, 78 arranged in generally like manner. Each aperture 78 communicates with a downwardly extending conductor guide slot 80 which is formed in the rib section and opens laterally outwardly therethrough. More specifically, each slot 80 is defined by an inner wall 82 and a pair of opposing side walls 84, 84, as best shown in FIG. 9. Preferably, and as shown, each conductor receiving aperture 78 comprises a generally conical downwardly converging aperture which communicates with an associated guide slot 80. The minor diameter of each aperture 78 or the diameter at its lower end is at least equal to the width of an associated guide slot 80, however, in the illustrated case the minor diameter of each aperture 78 is slightly greater than the width of its associated guide slot 80. Each guide slot is somewhat wider than it is deep and is dimensioned to accommodate a plug member to be received therein, as will be hereinafter further discussed. A color coded placard 81 is adhered to the upper surface of the panel section 68 and serves to identify the location of each aperture or contact hole 78 in accordance with a standard color code for the industry, such as the Munsell code.

Figure 6:
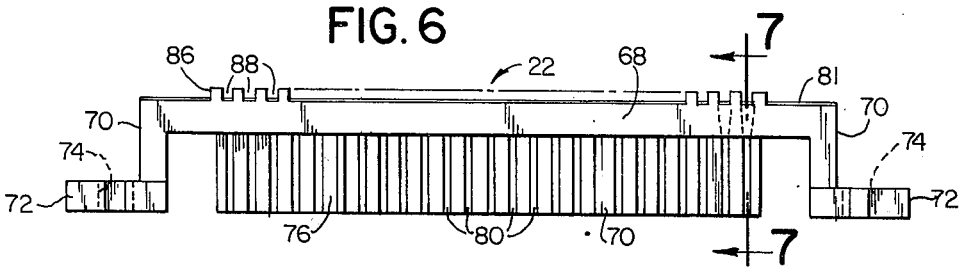
FIG. 6 is a side elevational view of the conductor adapter of FIG. 5.

Castelated ribs 86, 86 project upwardly from the upper surface of the panel section 68 and extend along the longitudinal opposite edges thereof, as best shown in FIGS. 5 and 6. Each rib 86 has a longitudinal series of conductor locating notches 88, 88 formed therein, each notch being laterally opposite an associated pair of conductor receiving apertures 78, 78.

A typical circuit bay 14 which includes receptacles 24 and 26 connected by strained relief covers 30, 30 and a connector adaptor 22 assembled in plugging relation therewith is attached to the panel 12 by suitable fasteners, such as the fasteners 44, 44. As previously noted, each bay is adapted to receive a multiplicity of individual electrical conductors or paired conductors in plugging engagement therein. The arrangement for plugging conductors into the adaptor 22 may vary. In FIG. 8 there is shown a pair of conductors 90, 90 terminated at a plug 92 which is plugged into the bay 14. The plug 92 is preferably formed from two identical half sections 93, 93 molded from electrical insulating material and joined together in face-to-face relation. The plug 92 carries a pair of wire prongs 94, 94 which are plugged into a pair of laterally spaced conductor receiving apertures 78, 78 and associated slots conductor guide slots 80, 80, substantially as shown. The prongs 94, 94 may be attached to the conductors 90, 90 within the plug 92, as shown in FIG. 8, or, if desired, the plug prongs may comprise bare terminal end portions of the conductors 90, 90.

The width of each guide slot 80 is preferably substantially equal to the diameter of an associated prong or conductor end portion to be received therein. However, the width of each guide slot 80 is somewhat greater than its depth, as is evident from FIG. 9. Thus, when each prong 94 is inserted into an associated guide slot 80, as shown in FIG. 8, a portion of the prong projects laterally from the slot and engages the contact portion 64 of an associated contact terminal 60, the contact portion being somewhat wider than the slot. The slots 80, 80 are dimensioned to cooperate with the slightly bowed contact portions 64, 64 to assure positive electrical contact when the plug 92 is assembled in plugging engagement with the bay 14.

Figure 10:
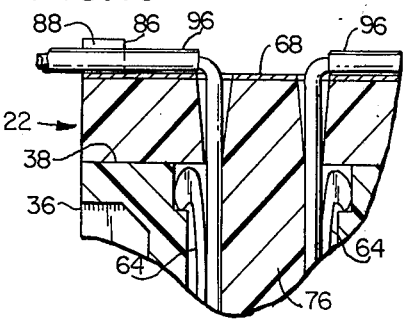
Fig. 10 is a fragmentary sectional view showing another conductor plugging arrangement.

Referring now to FIG. 10, there is shown another arrangement for plugging conductors into the adaptor 22 and wherein the slots and conductor receiving apertures in the adaptor 22 are specifically dimensioned to receive bare terminal end portions of electrical conductors in direct plugging engagement, as, for example, the bare end portion of a standard AWG No. 24 solid wire, thus wholly eliminating the need for a plug. In the illustrated embodiment 10 the electrical conductors or wires are indicated at 96, 96 and branch from a cable contained within an associated wire duct. Each conductor locating notch 88 receives an associated portion of a wire 96. The notches 88, 88 maintain the wires in orderly spaced apart relation and minimize risk of error when circuits are altered. This arrangement, which allows for direct plugging of bare wire end portions facilitates quick field circuit changes.

I claim:

1. In combination with a multi-contact electrical connector adapted for mounting on a panel and for connection to end portions of a multiplicity of first electrical conductors and having an insulated housing including a mating side and a connecting side, said housing having an elongated recess opening through said mating side and a mating surface surrounding said recess, means defining at least one contact supporting wall within said recess and extending longitudinally thereof, and at least one set of electrical contact terminals supported in longitudinal series in said housing, each of said contact terminals having a connecting portion exposed at the connecting side of said housing for connection to an associated one of the first electrical conductors and a contact portion disposed in said recess, the contact portions of said one set being arranged in longitudinal series generally adjacent said one contact supporting wall, a unitary conductor adaptor made from electrical insulating material and in plugging engagement with said electrical connector, said conductor adaptor including a panel section overlying an associated portion of said mating surface and a plugging section integrally connected to and projecting from said panel section and extending into said recess in plugging relation thereto, said adaptor having means for receiving axially elongated generally cylindrical bare terminal end portions of a multiplicity of individual second electrical conductors axially inserted thereinto when said conductor adaptor is in plugging engagement with said electrical connector, guiding each of the axially inserted end portions to slide relative to an associated one of said contacting portions to a position of electrically contacting engagement with said associated one of said contacting portions, and releasably retaining each of said bare terminal end portions in its position of electrical contacting engagement with an associated one of said contact portions to be freely removable in an axial direction from its position of electrical contacting engagement and from an associated aperture, said receiving, guiding, and releasably retaining means comprising at least one row of conductor end portions receiving apertures extending through said panel section and arranged in longitudinal series therealong, and at least one longitudinally spaced series of parallel conductor guide slots formed in said plugging section, each of said guide slots communicating with an associated aperture in said one row and opening toward said one contact supporting wall and an associated one of said contact portions.

2. The combination as set forth in claim 1 wherein said electrical connector housing includes means defining another contact supporting wall within said recess and parallel to said one contact supporting wall, said connector includes another set of electrical contact terminals, the contact portions of said other set being arranged in longitudinal series generally adjacent said other contact supporting wall and proximate said mating surface, and said receiving, guiding, and releasably retaining means comprises another row of conductor receiving apertures extending through said panel section and parallel to said one row and another longitudinally spaced series of parallel conductor guide slots formed in said plugging section, each of said guide slots in said other series communicating with an associated aperture in said other row and opening into said recess and toward an associated contact portion of said other set of electrical contacts.

3. In combination with a multi-contact electrical connector adapted for mounting on a panel and for connection to end portions of a multiplicity of first electrical conductors and having an insulated housing including a mating side and a connecting side, said housing having an elongated recess opening through said mating side and a mating surface surrounding said recess, means defining at least one contact supporting wall within said recess and extending longitudinally thereof, and at least one set of electrical contact terminals supported in longitudinal series in said housing, each of said contact terminals having a connecting portion exposed at the connecting side of said housing for connection to an associated one of the first electrical conductors and a contact portion disposed in said recess, the contact portions of said one set being arranged in longitudinal series generally adjacent said one contact supporting wall, a unitary conductor adaptor made from electrical insulating material and in plugging engagement with said electrical connector, said conductor adaptor including a panel section overlying an associated portion of said mating surface and a plugging section integrally connected to and projecting from said panel section and extending into said recess in plugging relation thereto, said adaptor having means for receiving elongated generally cylindrical bare terminal end portions of a multiplicity of individual second electrical conductors inserted thereinto after said adaptor is assembled in mating engagement with said connector, guiding each of said end portions into a position of electrically contacting engagement with an associated one of said contacting portions, and releasably retaining each of said end portions in its position of electrical contacting engagement, said receiving, guiding, and releasably retaining means comprising at least one row of conductor end portions receiving apertures extending through said panel section and arranged in longitudinal series therealong, and at least one longitudinally spaced series of parallel conductor guide slots formed in said plugging section, each of said guide slots communicating with an associated aperture in said one row and opening toward said one contact supporting wall and an associated one of said contact portions, each of said apertures having its axis parallel to the longitudinal axis of its associated guide slot, each of said apertures having a circular cross section and a taper converging in the direction of its associated guide slot.

4. The combination as set forth in claim 3 wherein said panel section is generally rectangular and said plugging section projects from a central portion of said panel section.

5. The combination as set forth in claim 2 wherein said panel section defines at least one longitudinal series of conductor receiving notches transversally spaced from said one row of conductor receiving apertures, each of said notches being disposed transversely opposite an associated one of said apertures.

6. The combination as set forth in claim 3 wherein said panel section has an integral rib extending longitudinally thereof, and transversely spaced from said one row of apertures and said one series of notches are formed in said rib.

7. The combination as set forth in claim 3 wherein the minor diameter of each of said apertures is at least equal to the width of said conductor guide slot associated therewith.

8. The combination as set forth in claim 7 wherein the width of each of said conductor guide slots is greater than the depth thereof.

9. The combination as set forth in claim 3 wherein said panel portion has conductor code indicia thereon associated with said one row of apertures and providing coded identification of each of said apertures in said one row.

10. The combination as set forth in claim 3 wherein said housing has mounting portions laterally spaced from said mating surface and extending longitudinally outwardly from its opposite ends and said panel section has mounting flanges integrally connected to its opposite ends and disposed in overlying relation with said mounting portions.

11. A conductor adaptor for plugging assembly with a multi-contact electrical connector and comprising a unitary structure made from electrical insulating material and including an elongated generally rectangular panel section and a plugging section integrally connected to the lower surface of said panel section and extending longitudinally thereof and downwardly therefrom, said conductor adaptor having means for receiving, guiding and supporting elongated generally cylindrical bare end portions of a multiplicity of individual electrical conductors assembled in plugging relation with said conductor adaptor, said means comprising at least one row of conductor end portion receiving apertures arranged in longitudinal series therealong and extending axially vertically through said panel section and opening through the upper and lower surfaces thereof and a longitudinally spaced series of parallel vertically disposed and laterally outwardly opening guide slots formed in said plugging section, each of said guide slots communicating with the lower end of an associated one of said apertures, each of said apertures having a circular cross section and a downwardly converging taper, each of said apertures having a diameter at its lower end at least equal to the width of an associated guide slot, said conductor adaptor having mounting means comprising a pair of legs integrally connected to said panel section and a pair of mounting flanges carried by said legs, each of said legs depending from an associated end portion of said panel section, said mounting flanges extending longitudinally outwardly in opposite directions from said legs, said mounting flanges having downwardly facing mounting surfaces disposed in a common plane parallel to said lower surface.

12. A conductor adaptor as set forth in claim 11 wherein each of said conductor guide slots is defined by an inner wall and a pair of opposing side walls and the width of each slot is greater than the depth thereof.

13. A conductor adaptor as set forth in claim 11 including means defining a multiplicity of conductor receiving notches associated with said panel section, each of said notches being laterally aligned with an associated one of said apertures.

14. A conductor adaptor as set forth in claim 13 wherein said notch defining means comprises a rib projecting upwardly from said upper surface and extending longitudinally of said panel section, said notches being formed in said rib.

* * * * *

UNITED STATES PATENT OFFICE

CERTIFICATE OF CORRECTION

Patent No. 4,116,525 Dated September 26, 1978

Inventor(s) James J. Johnston

It is certified that error appears in the above-identified patent and that said Letters Patent are hereby corrected as shown below:

Col. 1, line 47, after "section" insert --and--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*